US007533624B2

(12) United States Patent
Mizutani

(10) Patent No.: US 7,533,624 B2
(45) Date of Patent: May 19, 2009

(54) BOAT STEERING SYSTEM

(75) Inventor: Makoto Mizutani, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 53 days.

(21) Appl. No.: 11/859,533

(22) Filed: Sep. 21, 2007

(65) Prior Publication Data

US 2008/0210148 A1 Sep. 4, 2008

(30) Foreign Application Priority Data

Nov. 17, 2006 (JP) ..... 2006-312238

(51) Int. Cl.
*B63H 25/04* (2006.01)

(52) U.S. Cl. ..... 114/144 R; 114/144 E; 440/1

(58) Field of Classification Search ..... 114/144 E, 114/144 R, 144 RE; 440/1
See application file for complete search history.

(56) References Cited

U.S. PATENT DOCUMENTS 6,843,195 B2 * 1/2005 Watabe et al. ..... 114/144 E

FOREIGN PATENT DOCUMENTS

JP 04-038297 2/1992
JP 2959044 7/1999
JP 2005-254848 9/2005
JP 2006-069408 3/2006

OTHER PUBLICATIONS

U.S. Appl. No. 11/859,544, filed Sep. 21, 2007, entitled Watercraft Steering System.
U.S. Appl. No. 11/859,654, filed Sep. 21, 2007, entitled Watercraft Steering System.
U.S. Appl. No. 11/781,785, filed Jul. 23, 2007, entitled Steering System for Outboard Motor.
U.S. Appl. No. 11/853,731, filed Sep. 11, 2007, entitled Boat Steering System.

* cited by examiner

*Primary Examiner*—Lars A Olson
(74) *Attorney, Agent, or Firm*—Knobbe, Martens, Olson & Bear, LLP

(57) ABSTRACT

A boat has a propulsion unit and a steering system. The steering system includes a steering device actuated by an electric actuator. A steering wheel operated by an operator is electrically connected to the actuator. Detectors collect data regarding one or more of operation status of the steering wheel, running status of the boat, status of the propulsion unit(s), status of the electric actuator, and the like. Based upon such collected data, a current for powering the electric actuator may be selectively increased to provide increased torque to ensure excellent steering response even in changing.

19 Claims, 9 Drawing Sheets

[FIG. 1]
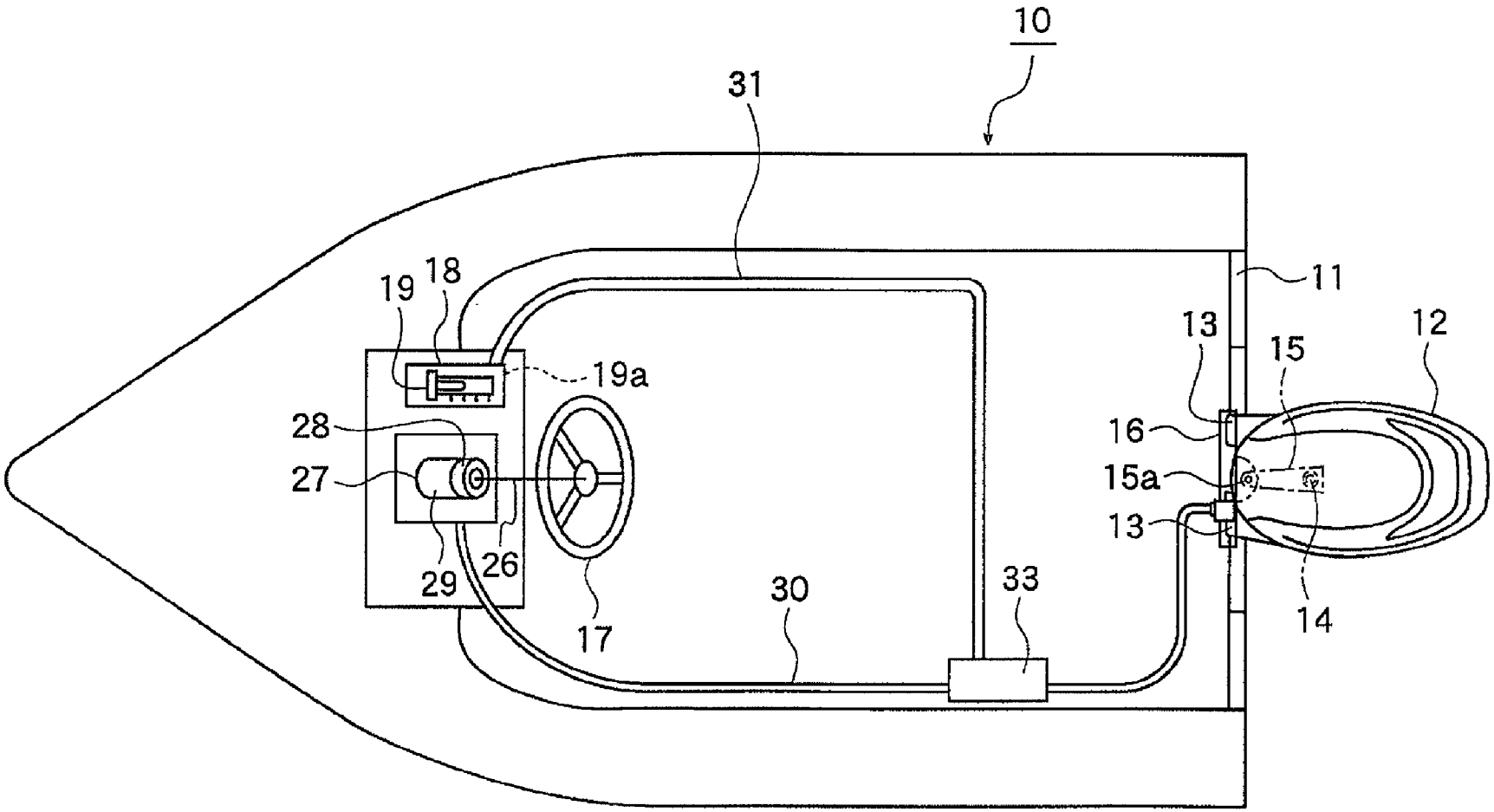

[FIG. 2]
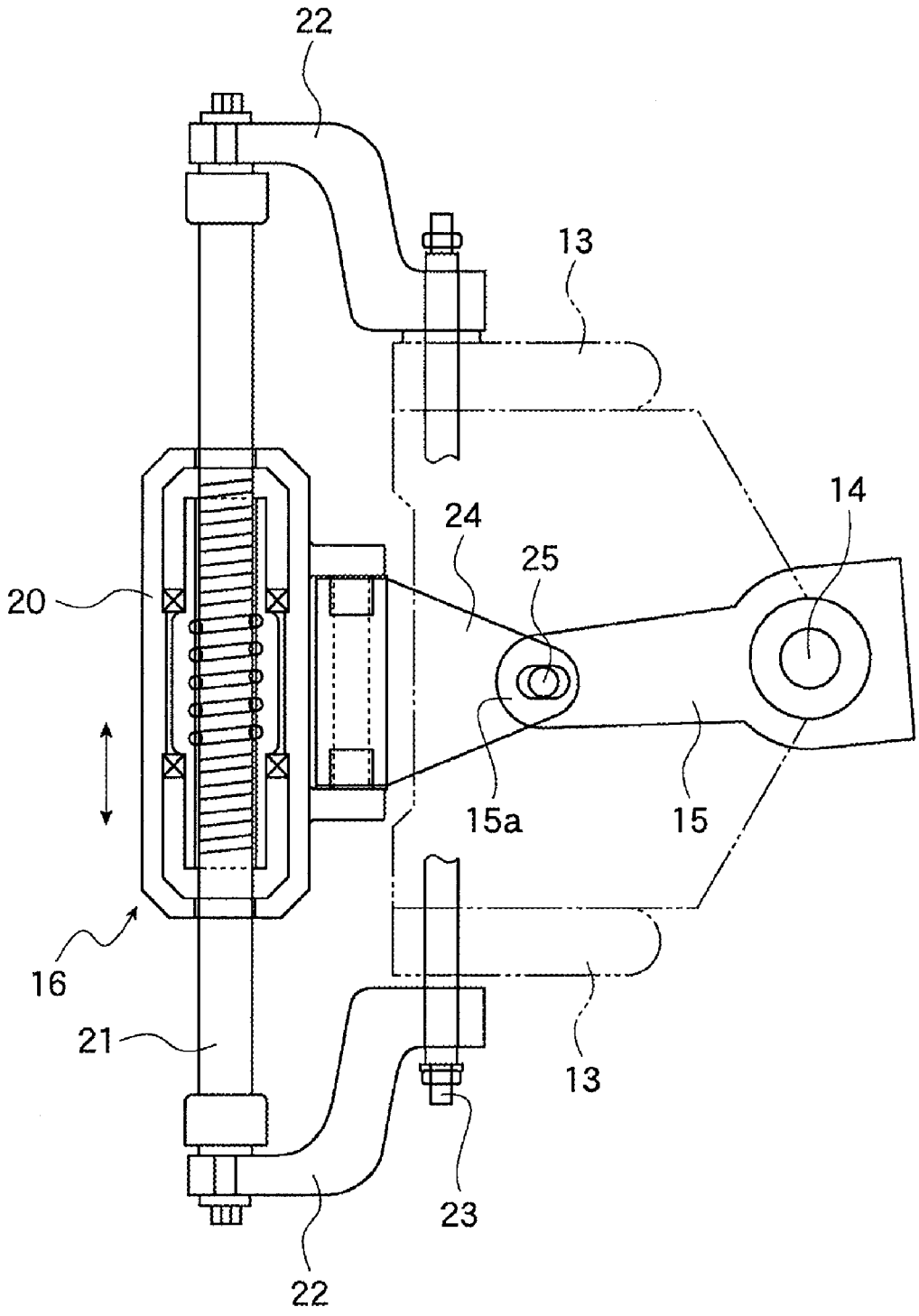

[FIG. 3]
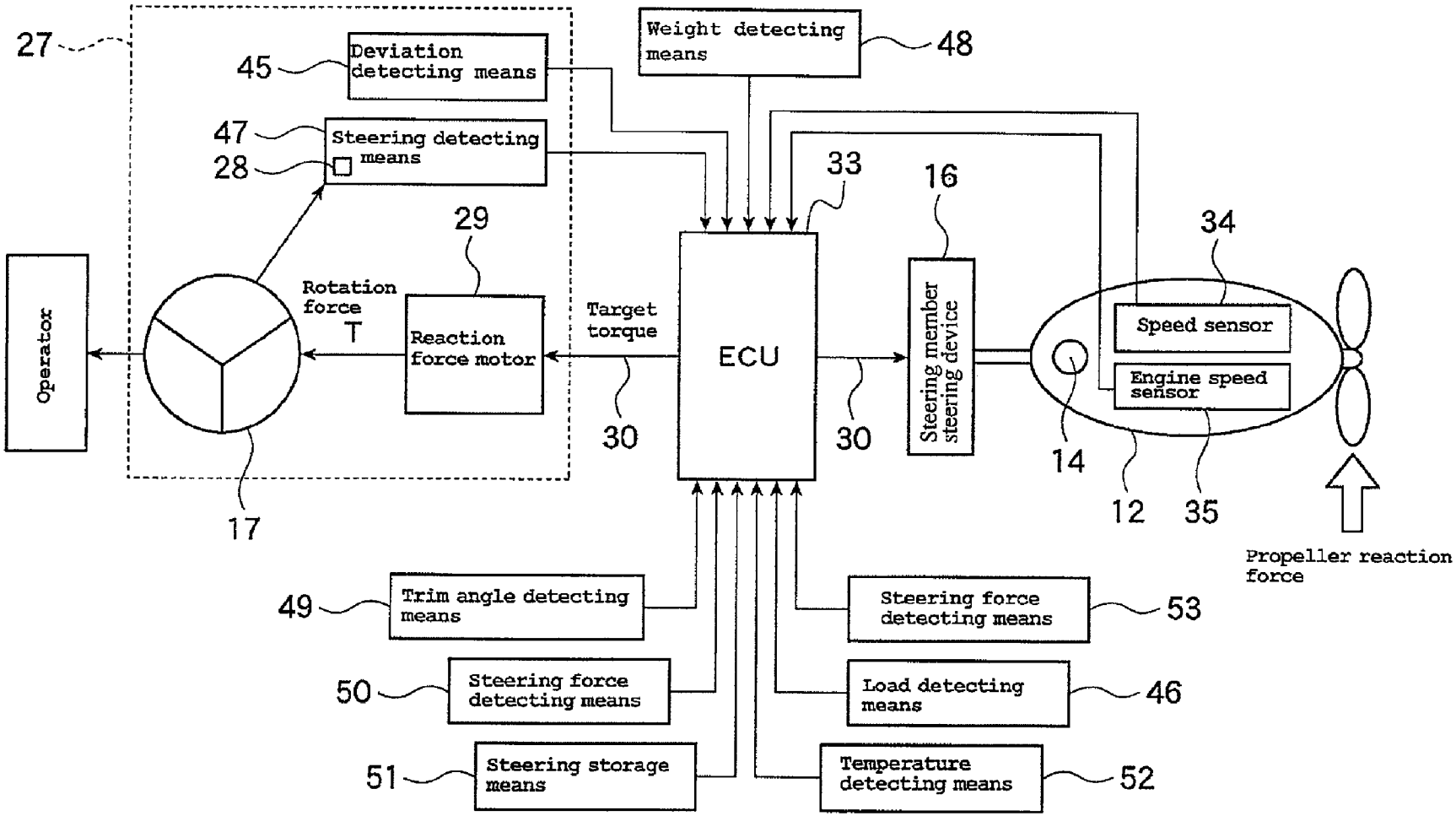

[FIG. 4]
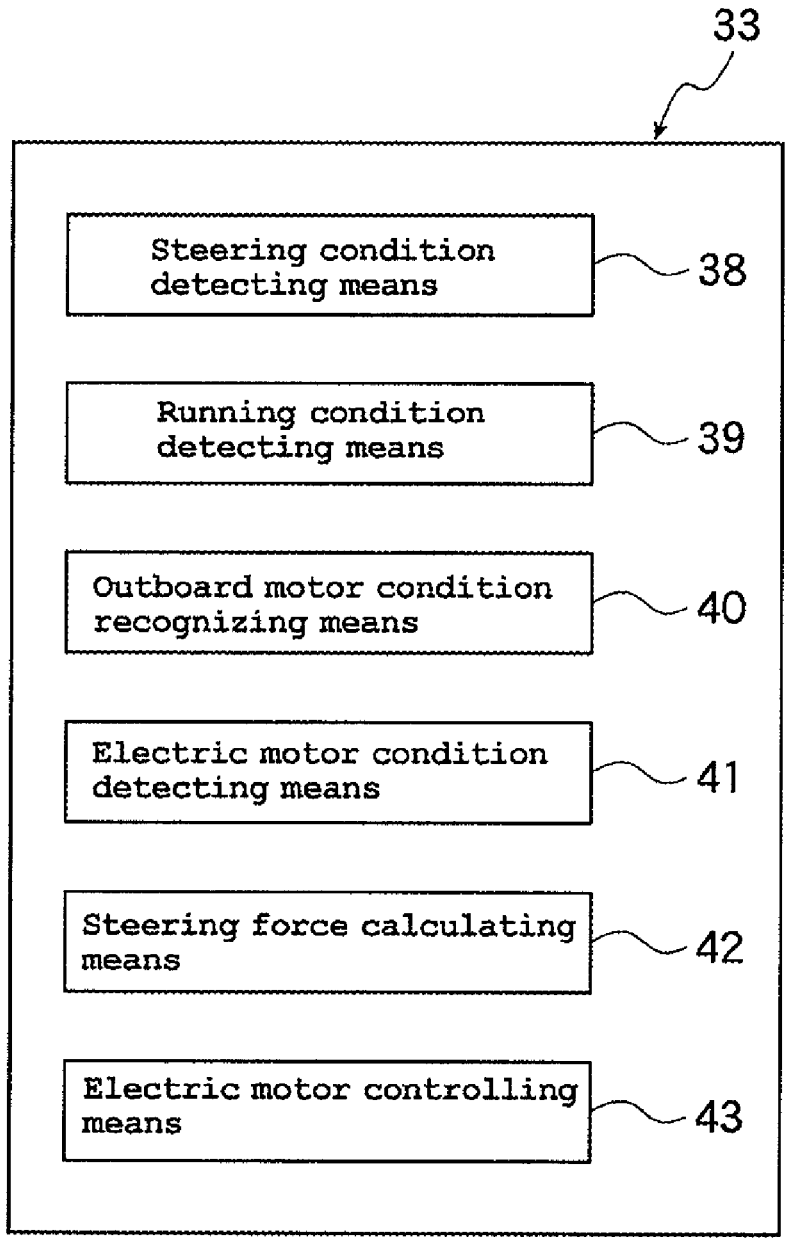

[FIG. 5]
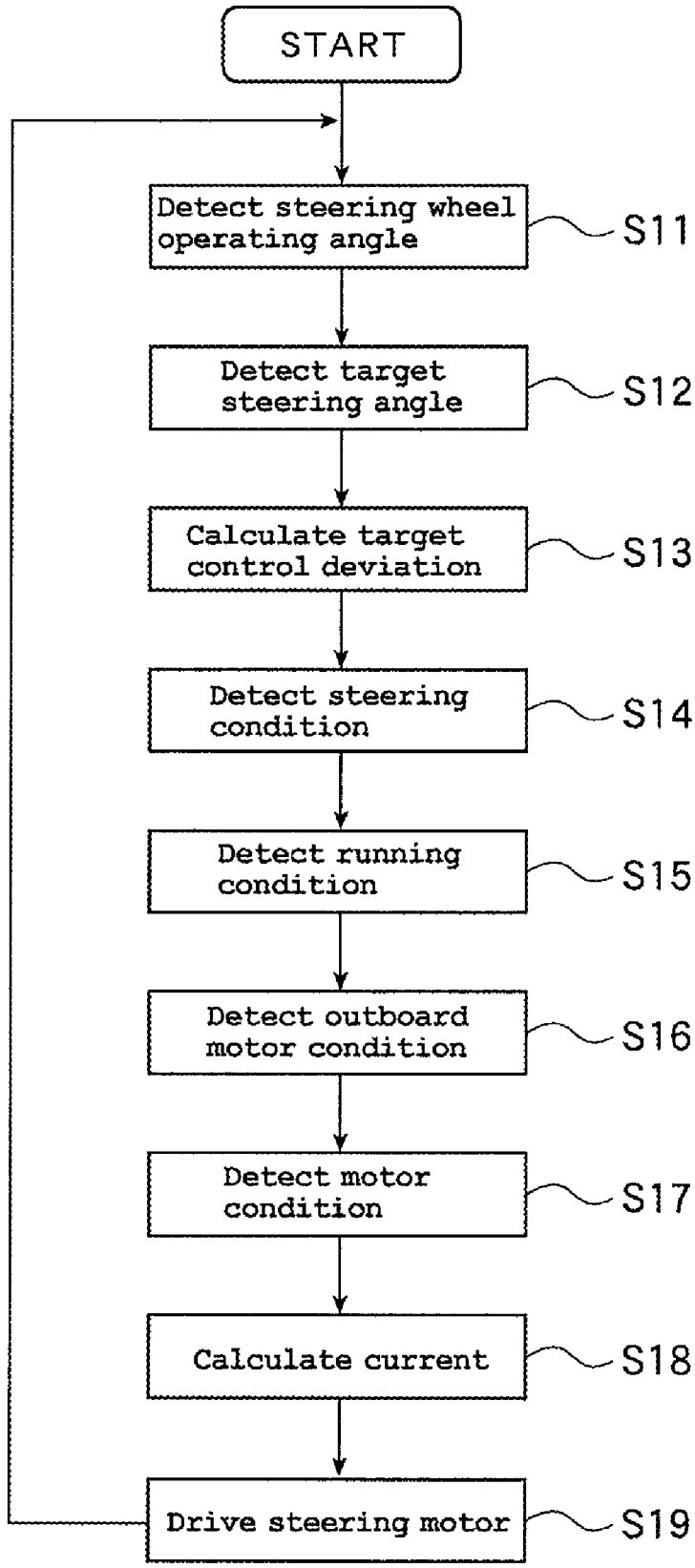

[FIG. 6]
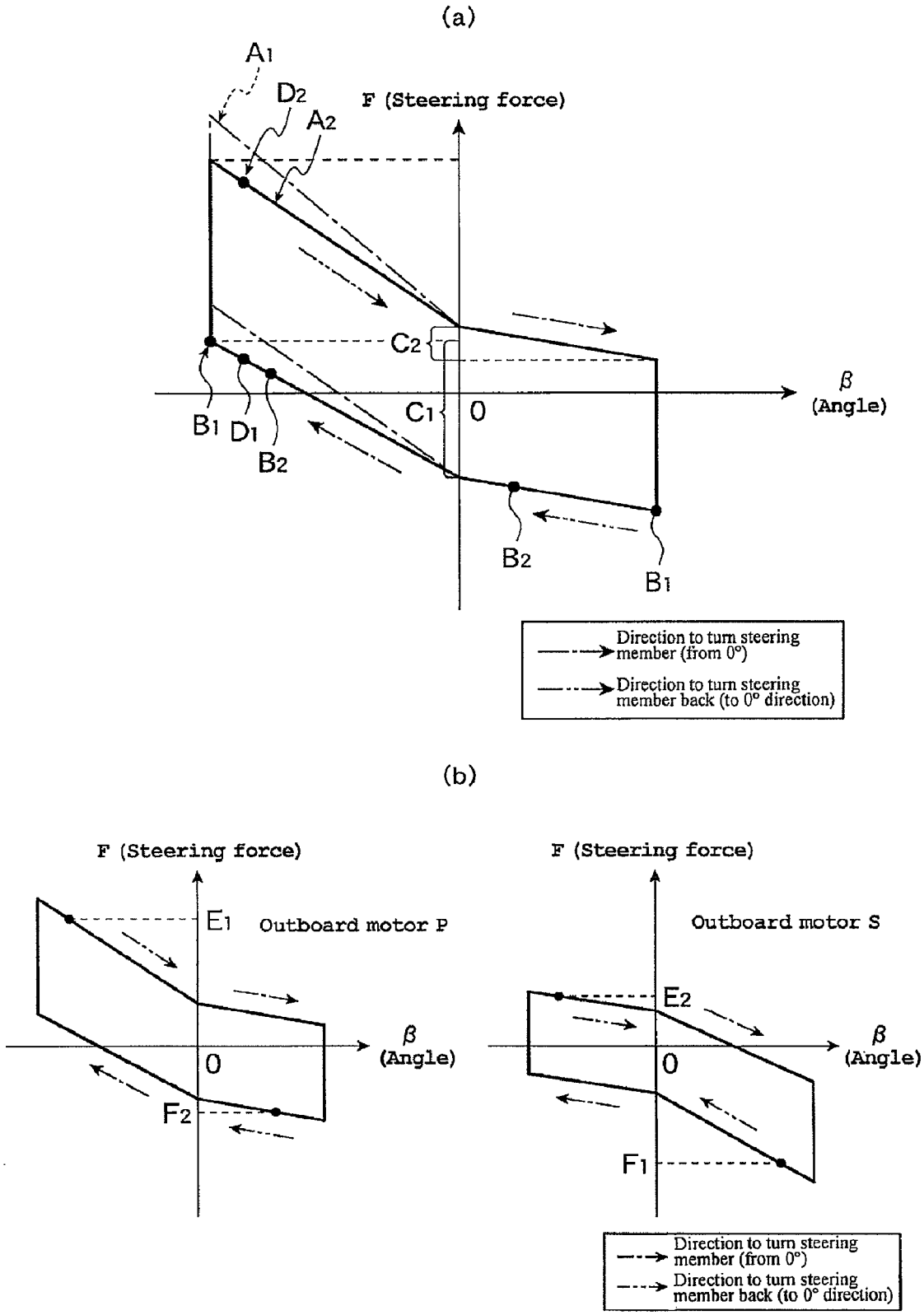

[FIG. 7]
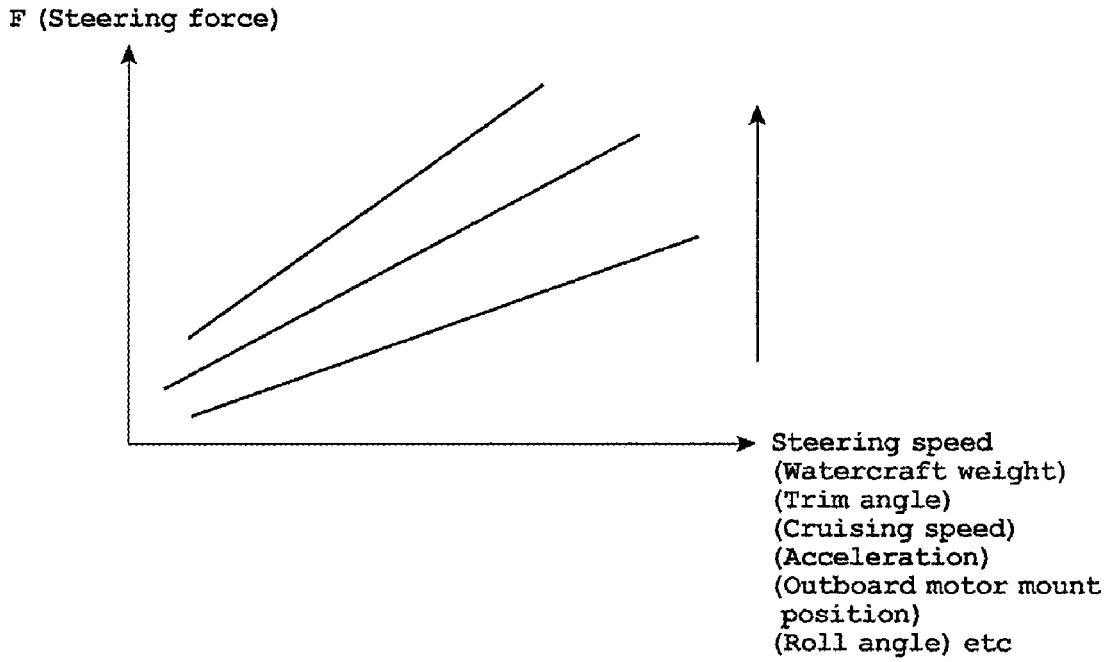

[FIG. 8]
(a)
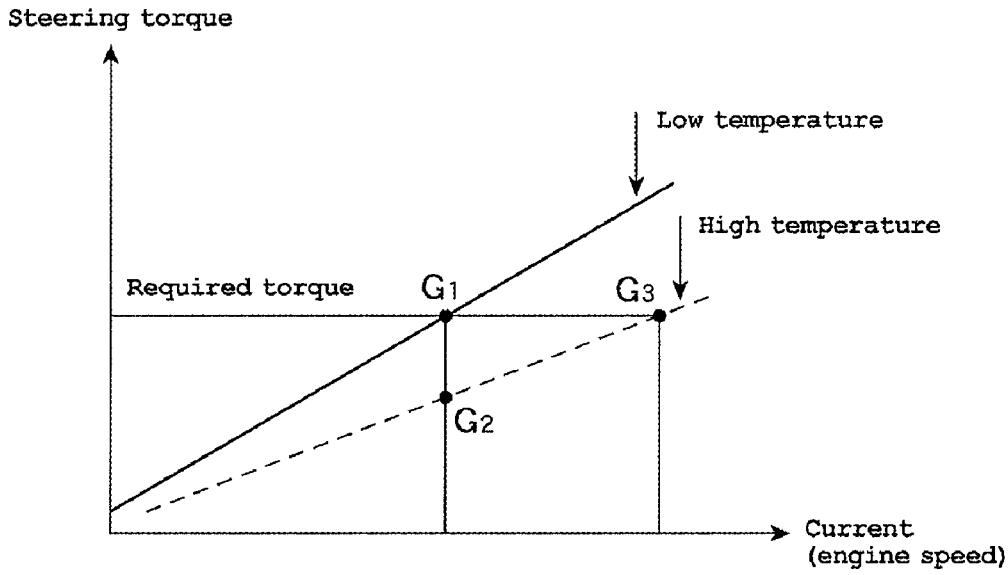
(b)
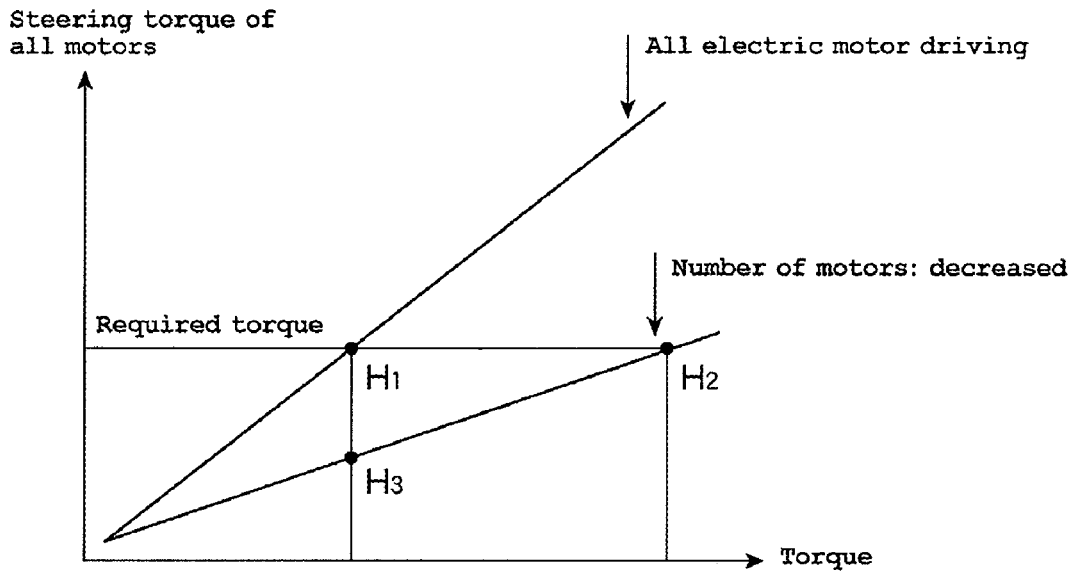

[FIG. 9]
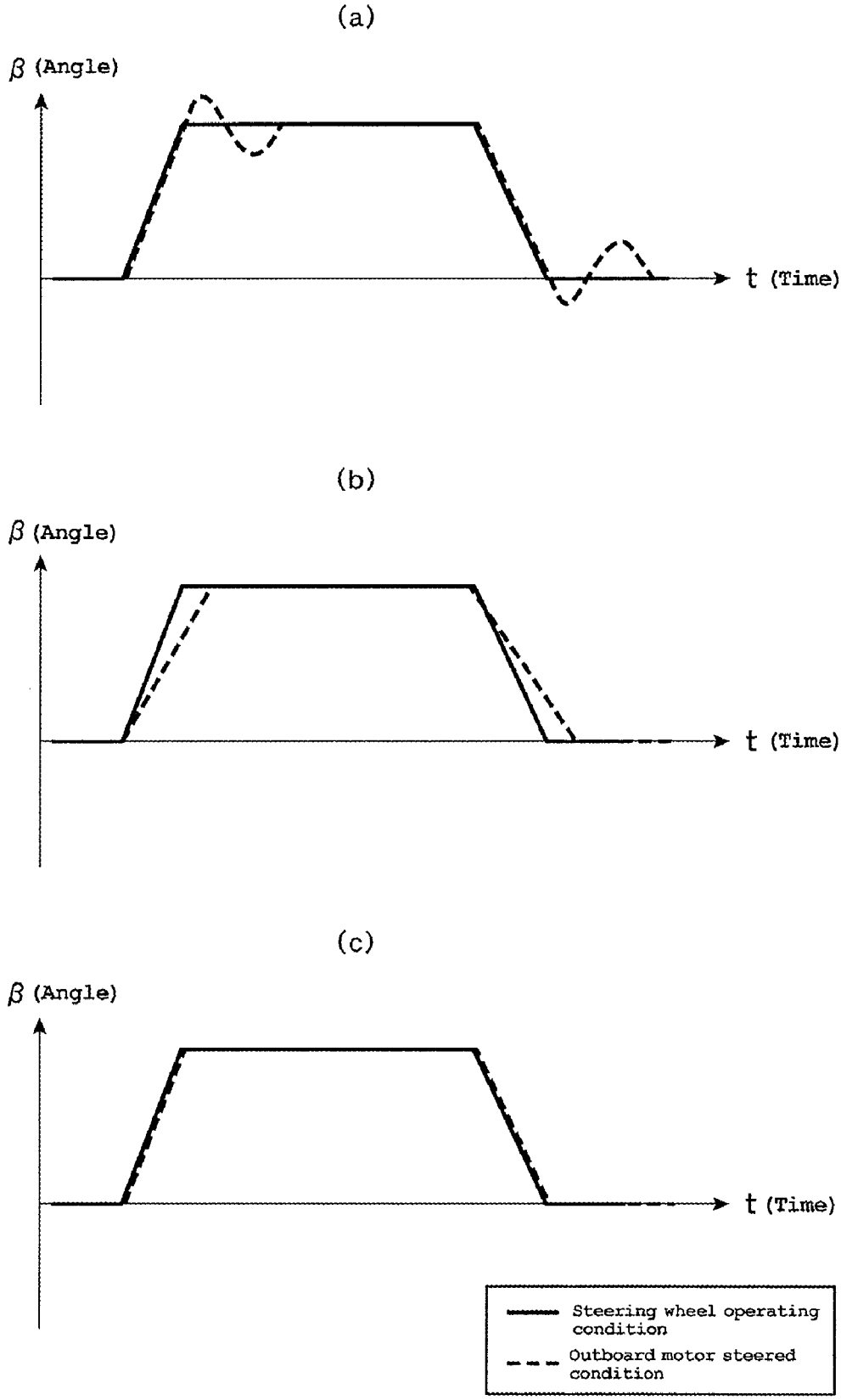

BOAT STEERING SYSTEM

CROSS-REFERENCE TO RELATED APPLICATIONS

The present application is based on and claims priority under 35 U.S.C. § 119 to Japanese Patent Application Serial No. 2006-312238, filed on Nov. 17, 2006, the entire contents of which are expressly incorporated by reference herein.

BACKGROUND OF THE INVENTION

1. Field of the Invention

The present invention relates to a steering system for a boat. More particularly, the invention relates to a boat steering system with an electric actuator.

2. Description of the Related Art

In a boat having an outboard motor mounted on a stern of a boat hull, it is known to have a steering system in which an electric actuator such as an electric motor applies a steering force to the outboard motor in response to an electric signal generated by operation of a steering wheel, as described in Japanese Patent Document No. JP-B-2959044. The load applied to the electric actuator for steering the outboard motor is referred to as "steering load". If an excessive drive current is provided to the electric motor when the steering load is small, a control amount may overshoot a target value and steering characteristics deteriorate as shown in FIG. 9(*a*).

In Patent Document JP-A-2006-69408, a steering system is disclosed in which the drive current provided to an electric motor is decreased when the boat cruises at a low speed. Here, the steering load is greater when the boat cruises at a high speed than when the boat cruises at a low speed. Therefore, the torque output by the electric motor in steering increases at high speed compared to low speed cruising.

However, the art does not teach a construction for increasing steering torque when needed during cruising, and torque requirements change during boat cruising. As such, a significant time lag exists between steering inputs from the steering wheel and actual steering of the outboard motor.

SUMMARY OF THE INVENTION

Applicant has recognized that the steering load changes due to not only a speed at which the boat cruises, but also a steering condition, such as a rotating angle and a steering speed of the outboard motor, a relationship between a rotating direction of a propeller provided on the outboard motor and the steering direction of the outboard motor, and a condition of the boat itself, such as a weight of the boat. Also, the steering load substantially changes due to a change in condition of the electric motor such as a change in temperature.

Accordingly, there is a need in the art for a steering system for a boat, which favorably maintains a response of the steering wheel when the steering load increases due to many factors and conditions.

In accordance with one embodiment, several parameters concerning the boat condition are detected and considered to determine the affect each parameter may have on the steering load exerted on the steering member and the ability of an associated electric actuator to satisfy that load so as to provide precise performance. Drive current to the electric actuator is increased or decreased so as to provide the appropriate steering load for optimum steering performance. Thus, the electric actuator applies a heavy torque when necessary, but a light torque when a heavy torque is not necessary. By providing the correct amount of torque based on detected conditions, steering performance is enhanced.

In accordance with another embodiment, a boat is provided having a propulsion unit and a steering system comprising a steering wheel and a steering member steering device driven by an electric actuator so as to change a steering direction of the boat. The steering wheel is operable by an operator and generates an actuation signal corresponding to steering wheel operation. The boat further comprises a control system for receiving the actuation signal and controlling the electric actuator based on the actuation signal of the steering wheel. The control system is further configured to obtain or receive detection data concerning at least one of a steering condition of the boat according to operation of the steering wheel, a running condition of the boat, an electric actuator condition, and data concerning a quantity and position of propulsion units. The control system is adapted to calculate a target steering force to be applied by the electric actuator based on the detection data, and to control operation of the electric actuator to apply the target steering force to the corresponding steering member steering device so as to maintain advantageous steering response even in changing conditions.

In one embodiment, the control system is adapted to increase a drive current provided to the electric actuator when the target steering force increases.

Another embodiment comprises a steering condition detector adapted to obtain detection data concerning at least one of a steering force necessary for steering according to an operation of the steering wheel, a force applied to the propulsion unit, an operating angle of the steering wheel, an operating speed of the steering wheel, an operating direction of the steering wheel, a rotating angle of the steering member driven according to operation of the steering wheel, a rotating speed of the steering member, a rotating direction of the steering member, and a deviation between a target steering angle in response to the operation of the steering wheel and a steered angle of the steering member.

Yet another embodiment comprises a running condition detector adapted to obtain detection data concerning at least one of a position of a waterline on the boat, a weight of the boat, a trim angle of the boat, a speed of the boat, an acceleration of the boat, propulsion of the boat, and an output of the propulsion unit.

In still another embodiment, the control system comprises a storage portion adapted to store detection data, the data including at least one of a quantity of propulsion units, a mount position of each propulsion unit on a hull of the boat, a rotating direction of a propeller of each propulsion unit, a propeller shape of the propeller of each boat, a trim tab angle, and a trim tab shape.

In a further embodiment, the boat comprises a plurality of outboard motors, each outboard motor having a steering member steering device that is actuated by an electric actuator via the control system.

In a still further embodiment, the control system is adapted to calculate the target steering force for each steering member by changing a gain in a PID control based on the detection data. A mount position of each outboard motor on a stern of the boat is recorded in the storage portion, and a gain in the PID control is calculated based at least in part upon the recorded mount position.

Yet another embodiment comprises an electric actuator condition detector adapted to obtain detection data concerning at least one of a number of electric actuator, and a temperature of each electric actuator.

In a further embodiment, the control system is adapted to calculate the target steering force by changing a gain in a PID control based on the detection data.

In accordance with another embodiment, the present invention provides a method of steering a boat having a propulsion unit supported by a hull, a steering member steering device, and an electric actuator adapted to drive the steering member to effect steering. The method comprises providing a controller adapted to control operation of the electric actuator, operating a steering wheel, generating a signal corresponding to steering wheel operation, communicating the steering wheel signal to the controller, communicating to the controller detection data concerning at least one of a steering condition of the boat according to operation of the steering wheel, a running condition of the boat, an electric actuator condition, and data concerning a quantity and position of propulsion units, calculating a target steering force to be applied by the electric actuator based on the detection data, and controlling operation of the electric actuator to apply the target steering force to the corresponding steering member steering device so as to maintain advantageous steering response even in changing conditions.

In one such embodiment, controlling the electric actuator comprises increasing or decreasing a drive current provided to the electric actuator to a degree so that the electric actuator applies the target steering force to the steering member.

In another embodiment, the drive current is calculated by a PID control, and the increase or decrease is drive current depends at least in part in a change in a gain of the PID control, and wherein the gain of the PID control changes at least in part based upon the detection data.

BRIEF DESCRIPTION OF THE DRAWINGS

FIG. 1 is a top plan view of a boat according to one embodiment.

FIG. 2 is an enlarged plan view of a steering member steering device of the boat of FIG. 1.

FIG. 3 is a block diagram of the boat showing interactions of some systems according to an embodiment.

FIG. 4 is a block diagram of aspects of an ECU in accordance with one embodiment.

FIG. 5 is a flowchart of a control process according to an embodiment.

FIG. 6(*a*) is a graph showing the relationship between steering angle and steering torque of an outboard motor according to an embodiment.

FIG. 6(*b*) is a graph showing the relationship between steering angles and steering forces of a plurality of outboard motors according to an embodiment.

FIG. 7 is a graph showing the relationship between steering force, steering speed and so other factors according to an embodiment.

FIGS. 8(*a*) and 8(*b*) are graphs showing a condition of reaction control in response to a running condition according to an embodiment.

FIGS. 9(*a*) and 9(*b*) are graphs showing the relationship between operating angle of a steering wheel and the steered angle of an outboard motor in a conventional steering system for a boat.

FIG. 9(*c*) is a graph showing the relationship between operating angle of a steering wheel and the steered angle of the outboard motor in the embodiment of a preferred embodiment.

DETAILED DESCRIPTION OF PREFERRED EMBODIMENTS

With initial reference to FIG. 1, an outboard motor 12 as a "boat propulsion unit" is mounted on a stern board 11 of a hull 10 via a clamp bracket 13. This outboard motor 12 is rotatable about a swivel shaft (steering pivot shaft) 14 extending in the vertical direction.

A steering bracket 15 is fixed to an upper end of the swivel shaft 14. A steering member steering device 16 is connected to a front end 15*a* of the steering bracket 15. The steering member steering device 16 is operated and driven by a steering wheel 17 disposed in a cockpit.

As shown in FIG. 2, the steering member steering device 16 has, for example, a DD (Direct Drive) type electric motor 20. The illustrated steering member steering device is structured in a manner such that the electric motor 20 is attached to a screw bar 21 disposed in the transverse direction and moves along the screw bar 21 in the transverse direction.

The ends of the illustrated screw bar 21 are supported by a pair of left and right supporting members 22. These supporting members 22 are supported by a tilt shaft 23.

A connection bracket 24 is provided to project rearward from the electric motor 20. The connection bracket 24 and the steering bracket 15 are connected together via a connection pin 25.

In the illustrated embodiment, the electric motor 20 drives and moves in the transverse direction relative to the screw bar 21, and thereby the outboard motor 12 rotates about the swivel shaft 14 via the connection bracket 24 and the clamp bracket 13.

As shown in FIG. 1, the steering wheel 17 preferably is fixed to a steering wheel shaft 26. A steering wheel control part 27 is provided at a base end of the steering wheel shaft 26. A steering wheel operating angle sensor 28 for detecting an operating angle of the steering wheel 17 and a reaction force motor 29 for applying a desired reaction force to the steering wheel 17 when the steering wheel 17 is operated are provided on the steering wheel control part 27.

The illustrated steering wheel control part 27 is connected to an ECU (Engine Control Unit) 33 via a signal cable 30. The ECU 33 is connected to the electric motor 20 of the steering member steering device 16. The ECU 33 is configured in a manner such that signals from the steering wheel operating angle sensor 28 are input to the ECU 33, and the electric motor 20 is controlled and driven by the ECU 33, while the reaction force motor 29 is also controlled by the ECU 33.

As shown in FIG. 4, the ECU 33 preferably includes: a steering condition detecting means 38 for detecting a steered condition according to an operation of the steering wheel; a running condition detecting means 39 for detecting a running condition of the boat; an outboard motor condition recognizing means 40, or "propulsion unit condition recognizing means" for recognizing a condition of the propulsion unit(s) such as the number of the outboard motor(s) 12; and an electric motor condition detecting means 41, or "electric actuator condition detecting means" for detecting a condition of the electric motor 20.

The ECU 33 also has a steering force calculating means 42 for calculating a steering force (torque amount) to be output by the electric motor 20 based on detected values from the steering condition detecting means 38, the running condition detecting means 39, the outboard motor condition recognizing means 40, and the electric motor condition detecting means 41.

The ECU 33 further has an electric motor controlling means 43, or "electric actuator controlling means", for controlling the electric motor 20 in response to a target steering force calculated by the steering force calculating means 42. The steering force calculating means 42 calculates the torque amount to increase a target steering force applied by the electric motor 20 when the load to the electric motor 20 actuated in steering is determined to increase (which will be described in detail below).

As shown in FIG. 3, the steering condition detecting means 38 is connected to a steering force detecting means 53 for detecting a steering force necessary for steering according to an operation of the steering wheel, a load detecting means 46 for detecting a load applied to the steering member such as water pressure, a steering detecting means 47 for detecting an operating angle of the steering wheel, an operating speed of the steering wheel, an operating direction of the steering wheel, a rotating angle of the steering member driven according to an operation of the steering wheel, a rotating speed of the steering member, and a rotating direction of the steering member, and a deviation detecting means 45 for detecting a deviation between a target steering angle in response to operation of the steering wheel and a steered angle of the steering member. The steering detecting means 47 preferably includes the steering wheel operating angle sensor 28 for detecting a steering angle. As such, a change in steering load applied to the electric motor 20 can be detected and calculated based on a change in operating condition of the steering wheel 17 that has a significant effect on the magnitude of the steering load.

As shown in FIG. 3, the running condition detecting means 39 preferably is connected to a weight detecting means 48 for detecting a position of a waterline and a weight of the boat, a trim angle detecting means 49 for detecting a trim angle of the boat, a speed detecting means 50 for detecting a speed, acceleration, and/or propulsion of the boat, and an output of the outboard motor 12, a speed sensor 34 for detecting a speed of the boat, and an engine speed sensor 35 for detecting an engine speed of the outboard motor 12. Thereby, a change in steering load applied to the electric motor 20 can be detected and calculated based on factors that have a significant effect on the magnitude of the steering load among the running conditions.

The numerous "means" introduced and discussed herein comprise detectors configured to detect the associated characteristics and generate an electronic signal that is communicated to the control unit 33 and/or to another detector. Such detectors may have any suitable structure, may employ one or more sensors working alone or in concert, may include stored data, may conduct calculations based upon sensor inputs and/or stored data, and the like.

The ECU 33 is configured to receive signals (for example, trim angle and propeller size) indicative of the boat information.

A steering storage means 51 preferably is connected to the outboard motor condition recognizing means 40. This steering storage means 51 preferably is a storage medium such as magnetic disk, ROM (Read Only Memory), and EPROM (Erasable Programmable Read Only Memory), in which information, such as the number of the outboard motor(s) 12, a mount position of the outboard motor 12 on the boat, a rotating direction of a propeller provided on the outboard motor 12, a propeller shape, a trim tab angle, a trim tab shape, and numerical data based on such information are stored as a table. The numerical data are data on a physical amount that varies based on each of the various condition changes of the boat, including the information mentioned above, and may be used to prompt a change to the load applied to the electric motor 20, and are used for calculating the drive current of the electric motor 20 as mentioned below. It should be understood that the steering storage means 51 may be contained inside the ECU 33.

A temperature detecting means 52 for detecting a temperature of the electric motor 20 preferably is connected to the electric motor condition detecting means 41. The temperature detecting means 52 in this embodiment includes a temperature sensor having, for example, a thermistor and a thermoelectric couple, and outputs a temperature signal changing based on a temperature of the electric motor 20. An electric actuator selecting means for selecting which electric motor(s) to drive and the number of the electric motor(s) to drive from among a plurality of the electric motors 20 may be connected to the electric motor condition detecting means 41 in embodiments in which there are a plurality of the electric motors 20 for steering the outboard motor 12.

It is to be understood that the above-described list of means or detectors does not necessarily comprise an exhaustive list of all the detectors that can be used in embodiments of the inventions and neither does it represent a minimum list of detectors. Rather, it presents an example embodiment. It is contemplated that other embodiments may employ more or less detectors (means) and that such means may be somewhat different in configuration and in their electronic interconnections than as specifically described in this example embodiment.

With reference next to FIG. 5, which is a flowchart of control according to one embodiment, when the steering wheel 17 is rotated by a prescribed amount by an operator, an operation signal is sent from the steering wheel operating angle sensor 28 of the steering detecting means 47 to the ECU 33. The steering condition detecting means 38 detects an operating angle of the steering wheel 17 based on the operation signal (step S11). Then, the steering condition detecting means 38 detects a target steering angle based on the operation signal (step S12), and calculates a target control deviation based on the operation signal (step S13).

The steering condition detecting means 38 detects a steering condition with steering signals sent from the load detecting means 46, the steering detecting means 47, and the deviation detecting means 45, and from a steering force detected by the steering force detecting means 53 (step S14). Here, the steering condition refers to torque amount necessary for steering of the outboard motor 12, an operating angle of the steering wheel, an operating speed of the steering wheel, an operating direction of the steering wheel, a rotating angle of the steering member driven according to an operation of the steering wheel, a rotating speed of the steering member, a rotating direction of the steering member, a deviation between a target steering angle in response to operation of the steering wheel and a steered angle of the steering member, and so forth.

The steering torque preferably is detected based on a steering signal provided from the load detecting means 46. The operating angle, the operating speed, and the operating direction of the steering wheel, and so forth preferably are detected based on a steering signal provided from the steering detecting means 47.

The running condition detecting means 39 preferably detects a running condition with running signals provided from the weight detecting means 48, the trim angle detecting means 49, the speed detecting means 50, the speed sensor 34, and the engine speed sensor 35 (step S15). In a preferred embodiment, the running condition refers to a position of a waterline, weight, a trim angle, a speed, acceleration, propulsion of the boat, an output of the outboard motor and so forth.

The position of a waterline and weight of the boat preferably are detected with running signals provided from the weight detecting means 48. The trim angle of the boat is detected with running signals provided from the trim angle detecting means 49. The speed, acceleration and propulsion of the boat and the output of the outboard motor 12 are detected with running signals provided from the speed detecting means 50.

The outboard motor condition recognizing means 40 recognizes a condition of the outboard motor 12 (step S16). In a preferred embodiment, the condition of the outboard motor 12 refers to a quantity of outboard motor(s) 12 (i.e. the number of outboard motor(s) provided on one boat), a mount position of the outboard motor 12 to the boat, a rotating direction of the propeller provided on the outboard motor 12, a propeller shape, a trim tab angle, a trim tab shape, and so forth.

The outboard motor condition recognizing means 40 recognizes a condition of the outboard motor 12, then preferably accesses the steering storage means 51 and obtains numerical data based on the recognized condition. Part of the information recognized by the outboard motor condition recognizing means 40, which does not change due to a change in steering condition and a change in running condition (for example, the number and mount position(s) of the outboard motor(s) 12, a weight of the outboard motor 12, and a rotating direction of the propeller) is stored as data in the steering storage means 51. If the step S16 is repeated twice or more, the outboard motor condition recognizing means 40 may read out and use the stored data.

Next, the electric motor condition detecting means 41 preferably detects a condition of the electric motor 20 with a temperature signal provided from the temperature detecting means 52 and so forth (step S17). In one embodiment, the condition of the electric motor 20 refers to a temperature, voltage of the electric motor 20, and so forth. In embodiments in which a plurality of electric motors 20 are provided, this condition preferably includes a determination of which electric motor(s) that is (are) driving and the number of the electric motor(s) that is (are) driving among a plurality of the electric motors 20.

The steering force calculating means 42 preferably calculates the torque amount to be output by the electric motor 20 (namely, a target steering force) based on values detected and calculated in the steps S11 through S17 (step S18). In one embodiment, the steering force calculating means 42 calculates a current value of drive current provided to the electric motor 20 as a torque amount to be output by the electric motor 20.

In the illustrated embodiment, the steering force calculating means 42 calculates a current value by applying the values detected and calculated in the steps S11 through S17 to a prescribed formula. The prescribed formula used here can be any kind appropriate for calculation of a current value. For example, the PID control formula (1) shown below is appropriate.

$$I=k1\Delta\beta=k2\int\Delta\beta dt=k3(d\Delta\beta/dt) \quad (1)$$

where:

I is the current value;

$\Delta\beta$ is the target control deviation;

k1 is the comparison gain;

k2 is the integral gain; and k3 is the differential gain.

In a preferred embodiment, the steering force calculating means 42 calculates the current value by applying the deviation calculated in the step S13 to the formula (1) and adding (or multiplying) the values detected in steps S12 and S14 through S17 to k1, k2 and k3 of the formula (1) as compensation values. Because a current value is calculated with a gain of PID control changed based on values detected in the steps S12 and S14 through S17, an increased amount of the steering load can be fed back so that the torque amount of the electric motor 20 can follow the feedback.

The electric motor controlling means 43 provides a drive current with the current value calculated in step S18 to the electric motor 20 (step S19). Thereby, the electric motor 20 rotates, outputs the torque amount calculated in the step S18, and steers the outboard motor 12.

The calculation of a current value mentioned above in this embodiment can be based on one or more types of conditions, as will be discussed.

In one embodiment, control of the electric motor 20 is made in response to and based upon a steering condition. Such an embodiment can be described in connection with FIG. 6(*a*), which is a graph showing the relationship between steering angle and steering force of the outboard motor 12. The relationship between steering direction and steering angle of the outboard motor 12, and magnitude of a steering force is as shown in the figure. Therefore, a larger force is necessary to steer the outboard motor 12 when the steering speed is faster (see "A1" shown in FIG. 6(*a*)) than when a steering speed is slower (see "A2" in the figure). Also, a larger force is necessary to steer the outboard motor 12 when a steering angle of the outboard motor 12 is larger (see "B1" in the figure.) than when a steering angle is smaller (see "B2").

As depicted in the relationship shown of FIG. 6(*a*), a larger force is necessary to steer the outboard motor 12 when the outboard motor 12 is steered in a direction in which the outboard motor 12 receives a reaction torque due to rotations of the propeller (see "C1" in the figure) than when steering in the other direction. In addition, a larger force is necessary to steer the outboard motor 12 when the outboard motor 12 is steered to reduce a particular steering angle (i.e. a turning the steering member back) (see "D2" in the FIG. 6) than when the outboard motor 12 is further steered in a direction to increase a steering angle (i.e. turning the steering member further) (see "D1" in the figure).

In this embodiment, as a steering speed is faster or a steering angle of the outboard motor 12 is larger, a larger drive current is provided to the electric motor 20. Also, a larger drive current is provided to the electric motor 20 when the outboard motor 12 is steered in a direction that it receives a reaction torque due to rotations of the propeller than when the outboard motor 12 is steered in the direction that it does not receive such a reaction torque.

Further, in this embodiment, the drive current is controlled such that a larger drive current is supplied to the electric motor 20 when the outboard motor 12 is steered in a direction to reduce a steering angle compared to the case that the outboard motor 12 is steered in a direction to increase a steering angle.

In this manner, the electric motor 20 appropriately increases its output torque amount when the steering load increases.

In other embodiments, control of the electric motor is made in response to and based upon a running condition. Such embodiments can be described in connection with FIG. 7 which is a graph showing the relationship between steering force and steering speed and so forth. As shown in the figure, the relationship between steering force and weight of the boat is a proportional relationship such that a steering force becomes greater as a weight of the boat becomes greater. Similarly, the relationship between steering force and trim angle, the relationship between steering force and speed of the boat, the relationship between steering force and acceleration (and deceleration), and so forth show the relationship such that a steering force becomes greater as each independent variable becomes greater (smaller in the case of trim angle).

In this embodiment, the drive current is controlled such that a larger drive current is supplied to the electric motor 20 as a weight of the boat is larger, a trim angle of the outboard motor 12 is smaller (that is, a depth that the outboard motor 12 is immersed under water is larger), a cruising speed of the boat is faster, or acceleration (or deceleration) of the boat is larger.

In embodiments in which the boat has a plurality of the outboard motors 12 (not shown in this embodiment), steering load characteristics in steering to the left and steering to the right are not identical when the boat is running, but not using one or more of the outboard motors 12 among a plurality of the mounted outboard motors 12, or when the respective trim conditions of the outboard motors 12 are different from each other (depths that lower parts of the outboard motors 12 are immersed under water are different).

In such embodiments, the drive current provided to the electric motor 20 is adjusted depending on whether the outboard motor 12 that is producing propulsion is on the right or left side in the width direction of the hull 10, and a larger drive current is provided when the steering load becomes larger.

Among a plurality of the outboard motors 12, the outboard motor 12 at an inner position of a turn is immersed deeper under water when the boat turns. Therefore, the outboard motor 12 at an inner position of a turn needs a steering force larger than does the outboard motor 12 at an outer position of the turn. This steering force is larger as the position is closer to the center of a turn. In addition, a larger steering force is necessary as the depth of immersion under water is larger. The graph in FIG. 7 shows a proportional relationship between mount position and steering force such that as a plurality of the outboard motors 12 are mounted on the outer side (that is, closer to the opposite ends of the stern board 11), a steering force of the outboard motor 12 at an inner position of a turn is larger. Also, the graph in FIG. 7 shows a proportional relationship between roll angle and steering force such that as a roll angle of the turning boat is larger, a steering force of the outboard motor 12 at an inner position of the turn is larger.

Thus, in such embodiments, if a plurality of outboard motors 12 are mounted, the outboard motor 12 at an inner position of a turn is provided with a drive current larger than the outboard motor 12 at an outer position of the turn is. Further, if a plurality of outboard motors 12 are mounted, and each outboard motor 12 is mounted on the outer side (that is, closer to the opposite ends of the stern board 11), the outboard motor 12 at an inner position of a turn is provided with a larger drive current than if each outboard motor 12 were mounted on the inner side (that is, closer to the center of the stern board 11). Supply of the drive current is controlled such that the outboard motor 12 at an inner position of a turn is provided with a larger drive current as a roll angle of the turning boat is larger. Thereby, the torque amount output by the electric motor 12 is appropriately increased when the steering load is larger.

In embodiments in which a plurality of outboard motors are mounted on the boat and each propeller rotates in a different direction, the direction in which each outboard motor 12 receives a reaction torque is different from each other. As a result, a steering force in steering each outboard motor 12 is different in each steering direction. For example, the graphs in FIG. 6(*b*) illustrates the case if two outboard motors 12 are mounted on the boat. When the boat is steered to one side, a steering force of the outboard motor 12 provided on the one side (see E1 in the figure) is greater than a steering force of the outboard motor 12 provided on the other side (see E2 in the figure). Conversely, when the boat is steered to the other side, a steering force of the outboard motor 12 provided on the other side (see F1 in the figure) is larger than a steering force of the outboard motor 12 provided on the one side (see F2 in the figure).

In this embodiment, supply of the drive current is controlled such that a greater drive current is provided to the electric motor 20 for steering the outboard motor 12 to be steered in a direction in which the outboard motor 12 receives a reaction torque in steering when a plurality of outboard motors are mounted and the rotating direction of the propeller of each outboard motor 12 is different from each other. Thereby, the torque amount output by the electric motor 20 can be appropriately increased when the steering load becomes larger.

In yet another embodiment, control of the electric motor 20 is made in response to a condition of the electric motor 20. Usually, motor characteristics change as a temperature of the motor rises. The illustrated electric motor 20 exhibits motor characteristics shown by a broken line in the graph in FIG. 8(*a*) as its temperature rises. That is, the steering torque output at a particular engine speed decreases as the temperature of the electric motor 20 rises (see G1 and G2 in the figure).

Here, the engine speed of the electric motor 20 is in an almost linear relationship with magnitude of the drive current. Thus, in this embodiment, as the temperature of the electric motor 20 rises, supply of the drive current is controlled such that the applicable electric motor 20 is provided with a larger drive current. Thereby, a driving condition of the electric motor 20 is adjusted and the torque amount equivalent to an amount at a low temperature is output (see G3 in FIG. 8(*a*)).

In embodiments in which the outboard motor 12 is steered and driven using a plurality of electric motors 20 (not shown in this embodiment), as the number of electric motors that can drive decreases as shown by a solid line in the graph of FIG. 8(*b*), the torque amount to be output by each available electric motor 20 for steering increases (see H1 and H2 in the figure).

Therefore, in this embodiment, supply of the drive current is controlled such that the individual electric motors 20 are provided with a larger drive current as the number of available electric motors 20 decreases (see H3 in FIG. 8(*b*)) when the outboard motor 12 is steered and driven using a plurality of the electric motors 20. Thereby, the torque amount output by each electric motor 20 can be appropriately increased when the steering load applied to each electric motor 20 becomes larger.

In another embodiment, control of the electric motor 20 is made in response to and based upon a condition of the outboard motor 12. Conditions of the outboard motor 12 itself, for example, the number of the outboard motor(s) 12, and the size and location of the propeller and trim tab (not shown), provided in each outboard motor 12, affect the magnitude of resistance for steering.

Thus, in this embodiment, supply of the drive current is controlled such that the electric motor 20 is provided with a larger drive current as the number of the outboard motors 12 mounted on the hull 10 increases. Also, supply of the drive current is controlled such that the electric motor 20 is provided with a larger drive current as sizes of the propeller and trim tab provided in the outboard motor 12 are larger. In the case that the trim tab angle deviates from a reference position in response to the cruising speed, trim angle, and waterline, supply of the drive current is controlled such that the electric motor 20 is provided with a larger drive current as a degree of the deviation is larger. Thereby, the torque amount output by each electric motor 20 can be appropriately increased when the steering load applied to each electric motor 20 becomes larger.

FIG. 9(*c*) is a graph of a steering response as a result of controlling the electric motor 20 as described herein. When the steering load becomes larger, the electric motor 20 is provided with a larger drive current based on the detected conditions as described above. Thereby, the torque amount increases where needed, and the steering condition of the steering wheel 17 can substantially correspond with the steered condition of the outboard motor 12.

As described above, in preferred embodiments, the electric motor controlling means 43 increases the drive current provided to the electric motor 20 when the target steering force becomes larger. Thereby, the torque amount output by the electric motor 20 can be increased when the load applied to the electric motor 20 increases.

In preferred embodiments as discussed above, certain prescribed physical conditions of a steering member can be detected. Such conditions tend to vary based on each of the various condition changes of the boat, which can change the load applied to the electric motor 20. When the load increases, the torque amount output by the electric motor 20 is controlled or increased based on a detected value of the physical condition. Thereby, a response of the steering wheel 17 can be favorably maintained when the steering load increases by detecting, considering, and adjusting for each of the various condition changes of the boat.

The outboard motor 12 is applied as a "boat propulsion unit" in the above embodiment. However, it should be understood that other types of propulsion units, such as an inboard-outdrive motor, may also be used. Further, some of the principles discussed herein can be used in embodiments in which the steering member is independent of the propulsion unit. In the above embodiment, the steering condition detecting means 38, the running condition detecting means 39, the outboard motor condition recognizing means 40 and the electric motor condition detecting means 41 are included. However, embodiments may use each of these detectors, a combination of some of them, or only one. Some embodiments may have only one or more of these detectors.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. For example, although individual embodiments were discussed that based increasing current to the actuator on a steering condition, a steering load, multiple propulsion units, or conditions of the steering motor (s), further embodiments consider multiple ones or all of these sensed conditions, as well as other sensed conditions that affect steering. Thus, it is intended that the scope of the present invention herein disclosed should not be limited by the particular disclosed embodiments described above, but should be determined only by a fair reading of the claims that follow.

What is claimed is:

1. A boat having a propulsion unit and a steering system comprising a steering wheel and a steering member steering device driven by an electric actuator so as to change a steering direction of the boat, the steering wheel being operable by an operator and generating an actuation signal corresponding to steering wheel operation, the boat further comprising a control system for receiving the actuation signal and controlling the electric actuator based on the actuation signal of the steering wheel, the control system further configured to obtain or receive detection data concerning at least one of a steering condition of the boat according to operation of the steering wheel, a running condition of the boat, an electric actuator condition, and data concerning a quantity and position of propulsion units, wherein the control system is adapted to calculate a target steering force to be applied by the electric actuator based on the detection data, and to control operation of the electric actuator to apply the target steering force to the corresponding steering member steering device so as to maintain advantageous steering response even in changing conditions.

2. The boat according to claim 1, wherein the control system is adapted to increase a drive current provided to the electric actuator when the target steering force increases.

3. The boat according to claim 1, comprising a steering condition detector adapted to obtain detection data concerning at least one of a steering force necessary for steering according to an operation of the steering wheel, a force applied to the propulsion unit, an operating angle of the steering wheel, an operating speed of the steering wheel, an operating direction of the steering wheel, a rotating angle of the steering member driven according to operation of the steering wheel, a rotating speed of the steering member, a rotating direction of the steering member, and a deviation between a target steering angle in response to the operation of the steering wheel and a steered angle of the steering member.

4. The boat according to claim 3, comprising a running condition detector adapted to obtain detection data concerning at least one of a position of a waterline on the boat, a weight of the boat, a trim angle of the boat, a speed of the boat, an acceleration of the boat, propulsion of the boat, and an output of the propulsion unit.

5. The boat according to claim 4, wherein the control system comprises a storage portion adapted to store detection data, the data including at least one of a quantity of propulsion units, a mount position of each propulsion unit on a hull of the boat, a rotating direction of a propeller of each propulsion unit, a propeller shape of the propeller of each boat, a trim tab angle, and a trim tab shape.

6. The boat according to claim 5, comprising an electric actuator condition detector adapted to obtain detection data concerning at least one of a number of electric actuator, and a temperature of each electric actuator.

7. The boat according to claim 6, wherein the control system is adapted to calculate the target steering force by changing a gain in a proportional-integral-derivative (PID) control based on the detection data.

8. The boat according to claim 3, wherein the control system comprises a storage portion adapted to store detection data, the data including at least one of a quantity of propulsion units, a mount position of each propulsion unit on a hull of the boat, a rotating direction of a propeller of each propulsion unit, a propeller shape of the propeller of each boat, a trim tab angle, and a trim tab shape.

9. The boat according to claim 3, comprising an electric actuator condition detector adapted to obtain detection data concerning at least one of a number of electric actuator, and a temperature of each electric actuator.

10. The boat according to claim 3, wherein the control system is adapted to calculate the target steering force by changing a gain in a proportional-integral-derivative (PID) control based on the detection data.

11. The boat according to claim 1, comprising a running condition detector adapted to obtain detection data concerning at least one of a position of a waterline on the boat, a weight of the boat, a trim angle of the boat, a speed of the boat, an acceleration of the boat, propulsion of the boat, and an output of the propulsion unit.

12. The boat according to claim 1, wherein the control system comprises a storage portion adapted to store detection data, the data including at least one of a quantity of propulsion units, a mount position of each propulsion unit on a hull of the boat, a rotating direction of a propeller of each propulsion unit, a propeller shape of the propeller of each boat, a trim tab angle, and a trim tab shape.

13. The boat according to claim 12, wherein the boat comprises a plurality of outboard motors, each outboard motor having a steering member steering device that is actuated by an electric actuator via the control system.

14. The boat according to claim 13, wherein the control system is adapted to calculate the target steering force for each steering member by changing a gain in a proportional-integral-derivative (PID) control based on the detection data, and wherein a mount position of each outboard motor on a stern of the boat is recorded in the storage portion, and a gain in the PID control is calculated based at least in part upon the recorded mount position.

15. The boat according to claim 1, comprising an electric actuator condition detector adapted to obtain detection data concerning at least one of a number of electric actuator, and a temperature of each electric actuator.

16. The boat according to claim 1, wherein the control system is adapted to calculate the target steering force by changing a gain in a proportional-integral-derivative (PID) control based on the detection data.

17. A method of steering a boat having a propulsion unit supported by a hull, a steering member steering device, and an electric actuator adapted to drive the steering member to effect steering, the method comprising providing a controller adapted to control operation of the electric actuator, operating a steering wheel, generating a signal corresponding to steering wheel operation, communicating the steering wheel signal to the controller, communicating to the controller detection data concerning at least one of a steering condition of the boat according to operation of the steering wheel, a running condition of the boat, an electric actuator condition, and data concerning a quantity and position of propulsion units, calculating a target steering force to be applied by the electric actuator based on the detection data, and controlling operation of the electric actuator to apply the target steering force to the corresponding steering member steering device so as to maintain advantageous steering response even in changing conditions.

18. A method of steering a boat as in claim 17, wherein controlling the electric actuator comprises increasing or decreasing a drive current provided to the electric actuator to a degree so that the electric actuator applies the target steering force to the steering member.

19. A method of steering a boat as in claim 18, wherein the drive current is calculated by a proportional-integral-derivative (PID) control, and the increase or decrease is drive current depends at least in part in a change in a gain of the PID control, and wherein the gain of the PID control changes at least in part based upon the detection data.

* * * * *